US010167101B2

(12) United States Patent
Yu Chen

(10) Patent No.: US 10,167,101 B2
(45) Date of Patent: Jan. 1, 2019

(54) FILM PACKING DEVICE

(71) Applicants: Hsiu-Man Yu Chen, Taichung (TW); René van Glabbeek, Etten Leur (NL)

(72) Inventor: Hsiu-Man Yu Chen, Taichung (TW)

(73) Assignees: Hsiu-Man Yu Chen, Taichung (TW); René Van Glabbeek, Etten Leur (NL)

( * ) Notice: Subject to any disclaimer, the term of this patent is extended or adjusted under 35 U.S.C. 154(b) by 756 days.

(21) Appl. No.: 14/715,349

(22) Filed: May 18, 2015

(65) Prior Publication Data

US 2016/0340070 A1 Nov. 24, 2016

(51) Int. Cl.

*B65B 67/08* (2006.01)
*B65H 16/00* (2006.01)
*B65B 59/00* (2006.01)

(52) U.S. Cl.

CPC ..... *B65B 67/08* (2013.01); *B65B 59/00* (2013.01); *B65B 67/085* (2013.01); *B65H 16/005* (2013.01); *B65H 2301/4128* (2013.01); *B65H 2301/41308* (2013.01); *B65H 2301/41346* (2013.01); *B65H 2402/412* (2013.01); *B65H 2402/542* (2013.01); *B65H 2403/42* (2013.01); *B65H 2701/1944* (2013.01)

(58) Field of Classification Search

CPC ..... B65B 67/08; B65B 67/085; B65B 59/00; B65H 16/005; B65H 2301/4128; B65H 2301/41308; B65H 2301/41346; B65H 2402/412; B65H 2402/542; B65H 2403/42; B65H 2701/1944

See application file for complete search history.

(56) References Cited

U.S. PATENT DOCUMENTS 5,531,393 A * 7/1996 Salzsauler ..... B29C 55/06 242/160.4
5,779,179 A * 7/1998 Zentmyer ..... B65B 67/085 242/423.2
D470,371 S * 2/2003 Van Glabbeek ..... D8/51
6,920,742 B1 * 7/2005 Yu Chen ..... B65B 67/085 156/574
8,104,705 B2 * 1/2012 Yu Chen ..... B65B 67/08 242/405.2
8,317,124 B2 * 11/2012 Yu Chen ..... B65B 67/085 242/588.6
2003/0208994 A1 * 11/2003 Gooding ..... B65B 67/085 53/557
2011/0233321 A1 * 9/2011 Yu Chen ..... B65B 67/085 242/588.2

(Continued)

*Primary Examiner* — Michael E Gallion

(74) *Attorney, Agent, or Firm* — Ming Chow; Sinorica, LLC

(57) ABSTRACT

A film packing device for a roll of film having or not having a reel includes a handle. Two ends of the handle are provided with a coupling rod and a base, respectively. The coupling rod is provided with a quick-release unit. The base is provided with a limit unit. The quick-release unit and the limit unit are selectively mounted with a first film application unit and a second film application unit. Through the first film application unit, the film packing device can be mounted with a roll of film having a paper reel. Through the second film application unit, the film packing device can be mounted with a roll of film not having a paper reel. The film packing device can be replaced with different types of film in a simple and quick way.

9 Claims, 16 Drawing Sheets

(56) References Cited

U.S. PATENT DOCUMENTS

| | | | | |
|---|---|---|---|---|
| 2015/0353215 | A1* | 12/2015 | Yu Chen | B65H 16/005<br>53/203 |
| 2016/0340070 | A1* | 11/2016 | Yu Chen | B65B 67/08 |
| 2016/0355373 | A1* | 12/2016 | Yu Chen | B65H 16/005 |

* cited by examiner

FILM PACKING DEVICE

BACKGROUND OF THE INVENTION

1. Field of the Invention

The present invention relates to a film packing device, and more particularly to a film packing device for a roll of film having or not having a reel.

2. Description of the Prior Art

The actual method of film packing device is using a roll of film on a paper reel, bend over, walk backwards and pull on the roll manually. This causes back pain, unsafe situations and inconsistent application of the film, resulting in bad load stabilization and transport damage. Also in practice the roll drops on the floor and will be useless because of the occurred damage.

FIG. 1 is a perspective view of a conventional film packing device for a roll of film having a reel. FIG. 2 is a partial sectional view of FIG. 1. A conventional film packing device 300 for a roll of film having a paper reel comprises a handle 5. Two ends of the handle 5 have screw holes 6, such that the handle 5 is pivotally connected with a film application unit 7 through the screw holes 6. The two ends of the handle 5 are further pivotally connected with a roller unit 8 corresponding to the film application unit 7 for the film packing device 300 to pack an article.

FIG. 3 is a perspective view of a conventional film packing device for a roll of film not having a reel which is coreless film. FIG. 4 is a partial sectional view of FIG. 3. A conventional film packing device 200 for a roll of film not having a paper reel comprises a handle 1. Two ends of the handle 1 have positioning recesses 2, such that the handle 1 is pivotally connected with a film application unit 3 through the positioning recesses 2. The two ends of the handle 1 are further pivotally connected with a roller unit 4 corresponding to the film application unit 3 for the film packing device 200 to pack an article.

Referring to FIG. 2 and FIG. 4, the conventional film packing device 300 is threadedly connected with the film application unit 7 through the screw holes 6. The conventional film packing device 200 is connected with the film application unit 3 through the positioning recesses 2. The conventional film packing device can be mounted with a specific film application unit only. If the user has to use different types of film application units, it is necessary to prepare for different types of film packing devices. This is very inconvenient for use. Accordingly, the inventor of the present invention has devoted himself based on his many years of practical experiences to solve these problems.

SUMMARY OF THE INVENTION

The present invention is to provide a film packing device for a roll of film having or not having a reel. The film packing device can be mounted with a roll of film having a reel or a roll of film not having a reel.

In order to achieve the aforesaid object, the film packing device for a roll of film having or not having a reel of the present invention comprises a handle, a first film application unit, and a second film application unit. Two ends of the handle extend in the same direction and are provided with a coupling rod and a base, respectively. The coupling rod is provided with a quick-release unit. The quick-release unit comprises an elastic member and a retaining member. The elastic member elastically holds against the retaining member. The retaining member has a first retaining portion and a second retaining portion. The base is provided with a limit unit. The limit unit comprises a first limit portion and a second limit portion. The first film application unit comprises a first film seat and a second film seat. The first film seat and the second film seat are disposed oppositely. The first film seat comprises a first fixing portion corresponding to the second retaining portion. The second film seat comprises a second fixing portion corresponding to the limit unit. The second film application unit comprises an axial rod. The axial rod comprises a first positioning portion and a second positioning portion corresponding to the first retaining portion and the first limit portion, respectively;

Through the first film application unit, the film packing device can be mounted with a roll of film having a paper reel. Through the second film application unit, the film packing device can be mounted with a roll of film not having a paper reel. The film packing device can be applied to a roll of film having or not having a paper reel and can be replaced with different types of film in a quick, simple and convenient way.

DETAILED DESCRIPTION OF THE PREFERRED EMBODIMENTS

Embodiments of the present invention will now be described, by way of example only, with reference to the accompanying drawings.

Figure 1:
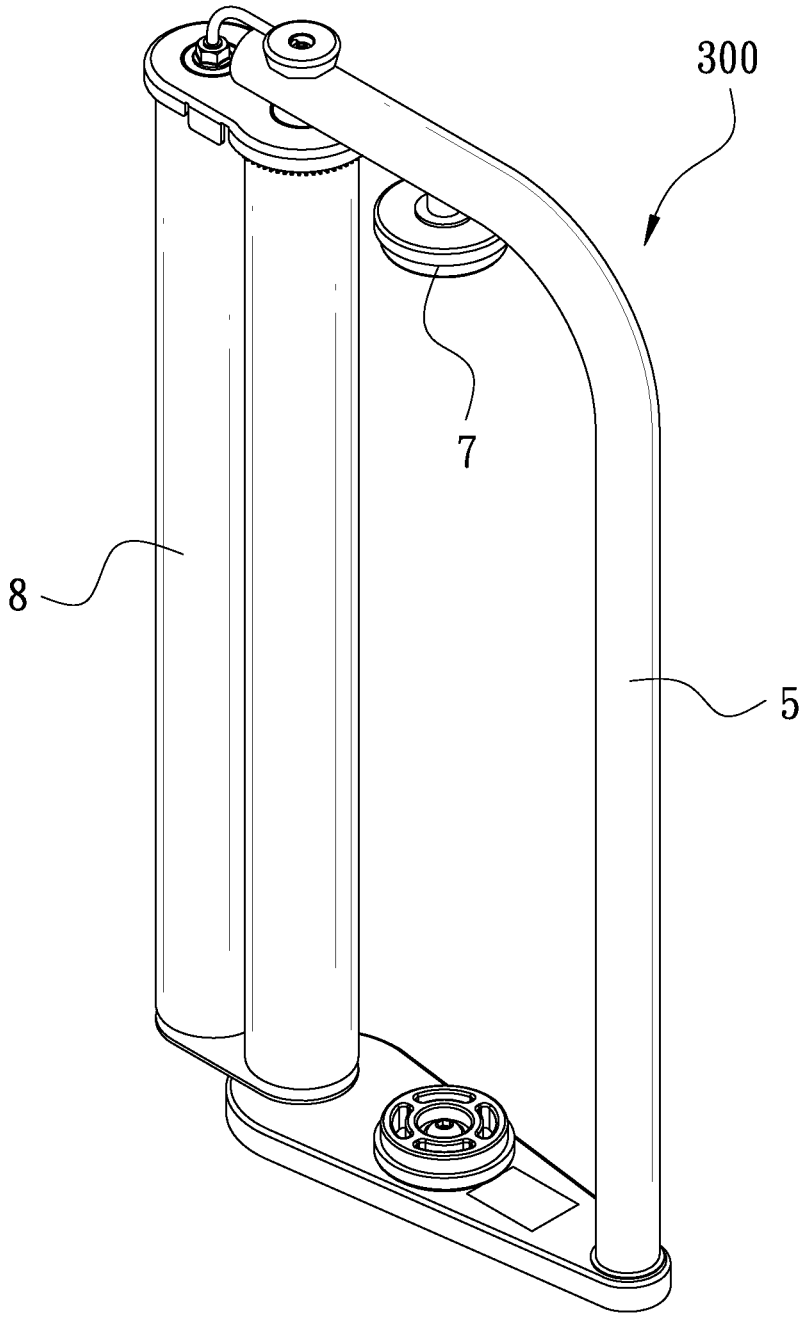
FIG. 1 PRIOR ART
FIG. 1 is a perspective view of a conventional film packing device for a roll of film having a reel.
Figure 2:
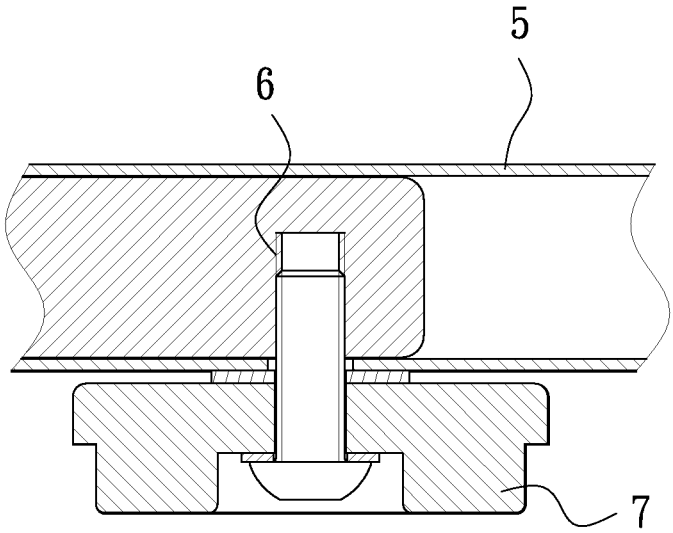
FIG. 2 PRIOR ART
FIG. 2 is a partial sectional view of FIG. 1.
Figure 3:
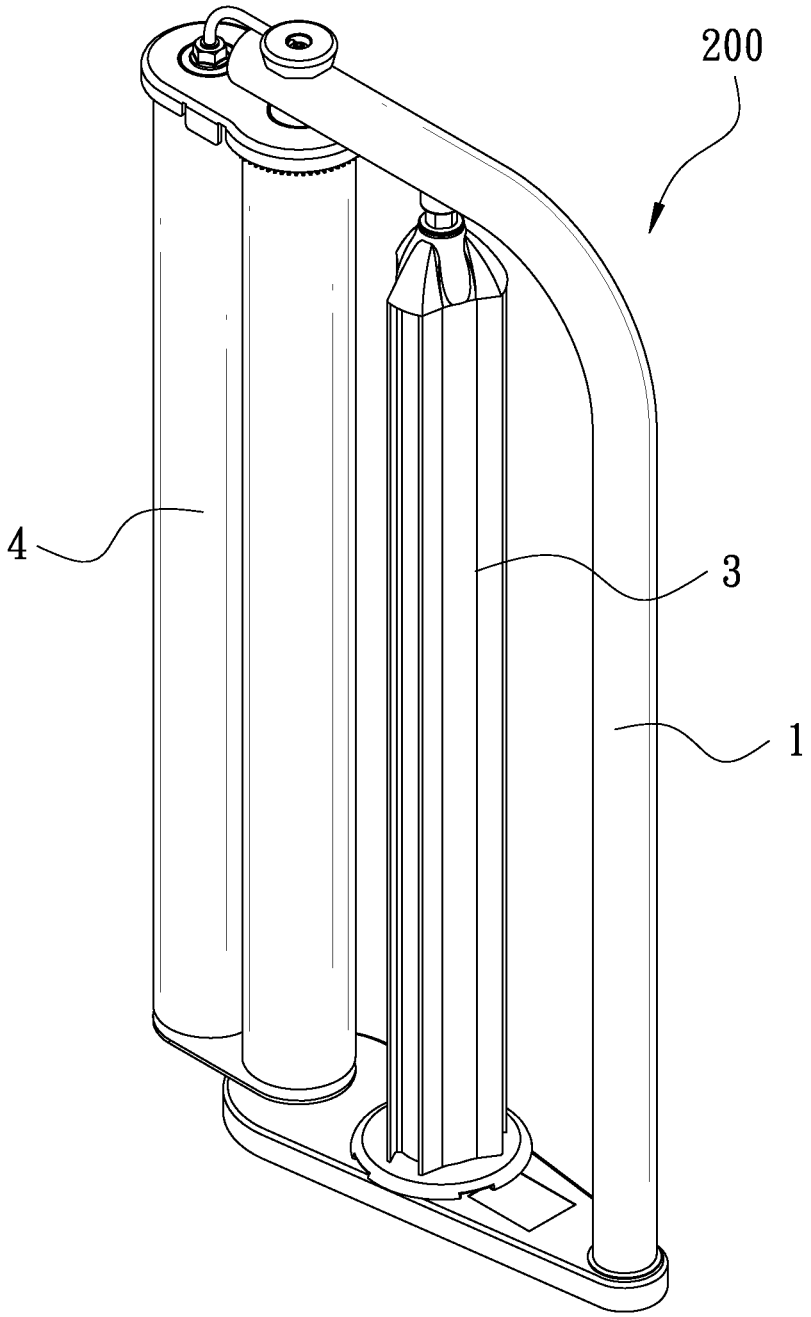
FIG. 3 PRIOR ART
FIG. 3 is a perspective view of a conventional film packing device for a roll of film not having a reel.
Figure 4:
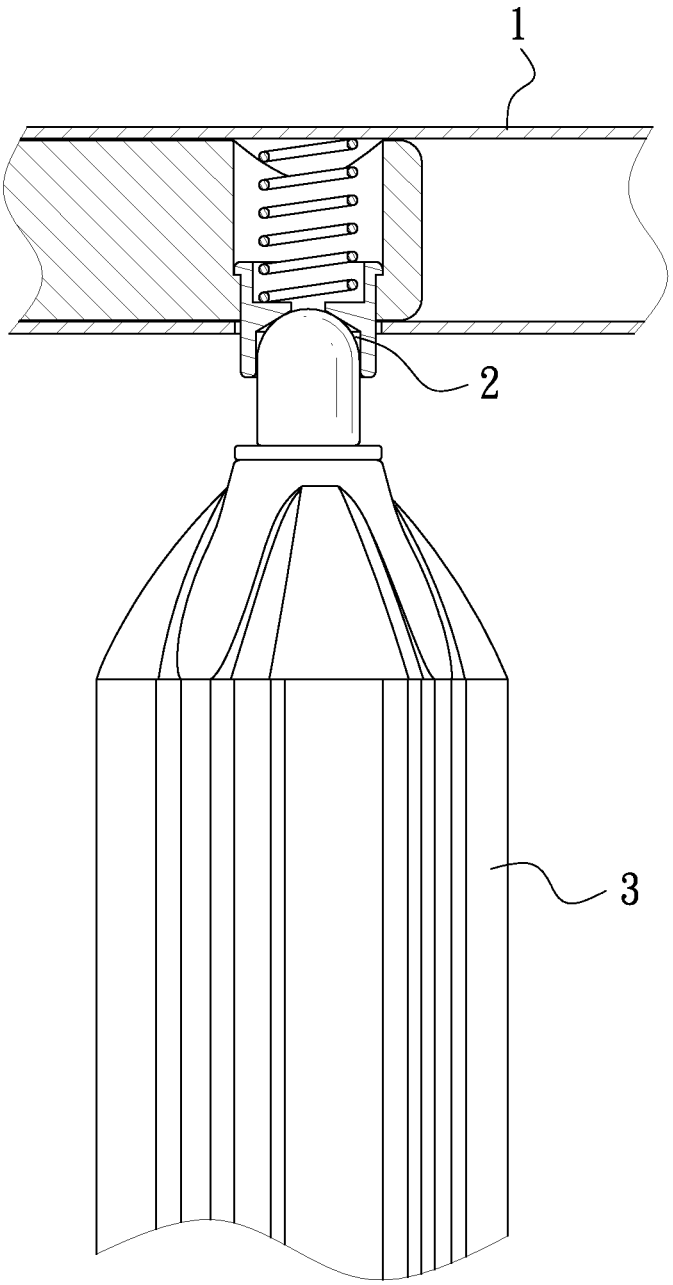
FIG. 4 PRIOR ART
FIG. 4 is a partial sectional view of FIG. 3.
Figure 5:
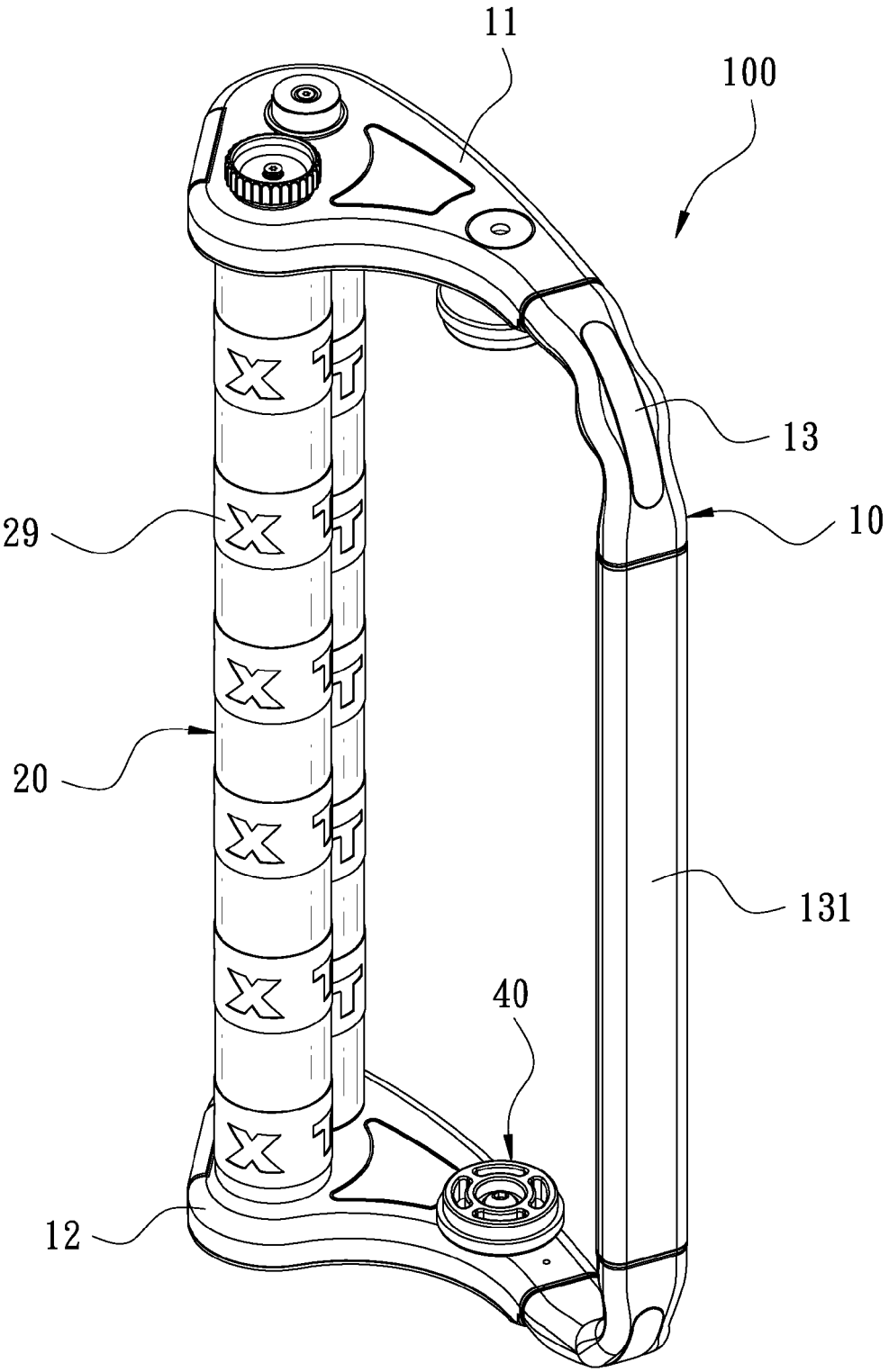
FIG. 5 is a perspective view according to a first embodiment of the present invention.
Figure 6:
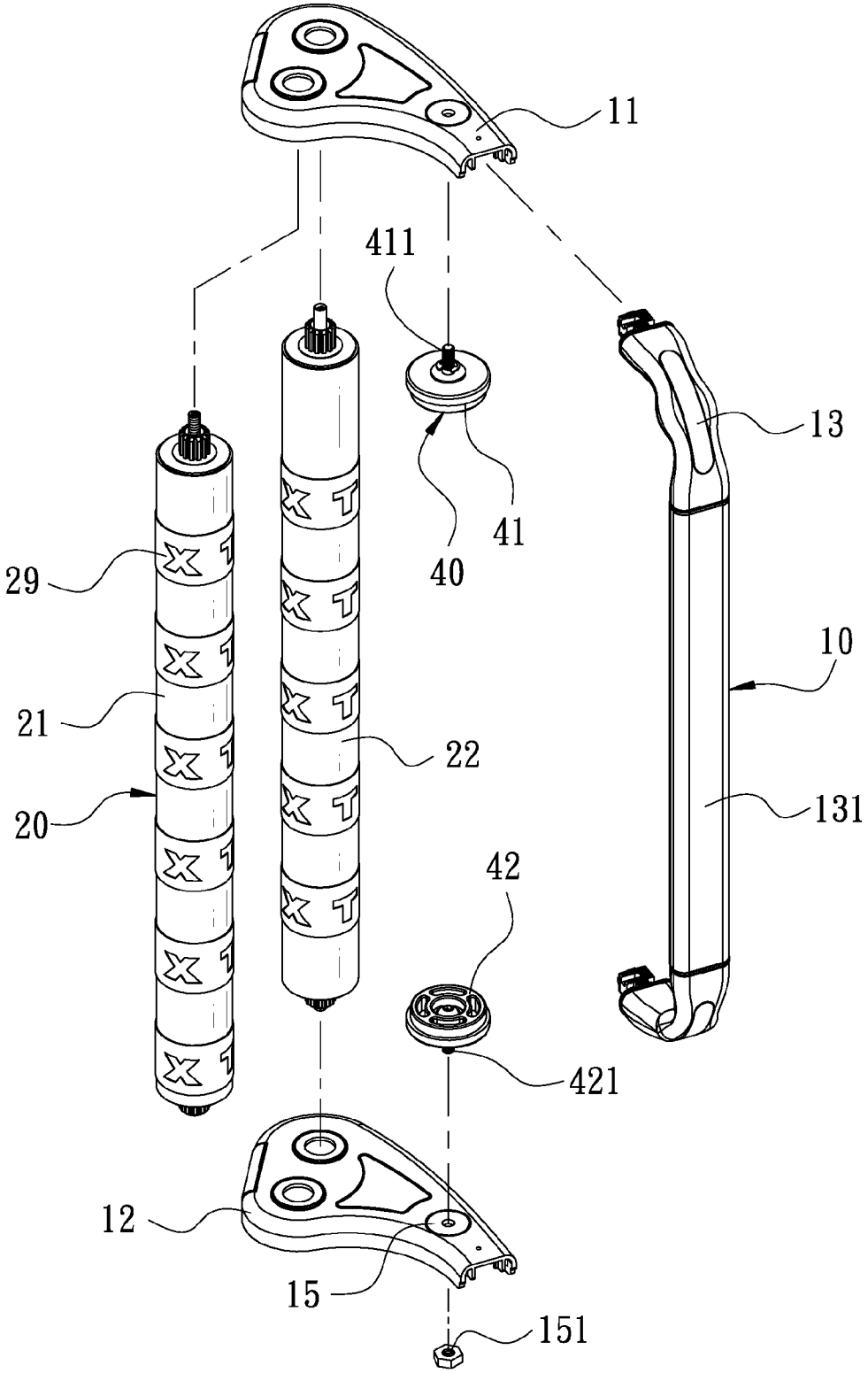
FIG. 6 is an exploded view according to the first embodiment of the present invention.

FIG. 5 is a perspective view according to a first embodiment of the present invention. FIG. 6 is an exploded view according to the first embodiment of the present invention. The present invention discloses a film packing device 100 for a roll of film having or not having a reel. The film packing device 100 comprises a handle 10 and a roller unit 20.

Figure 8:
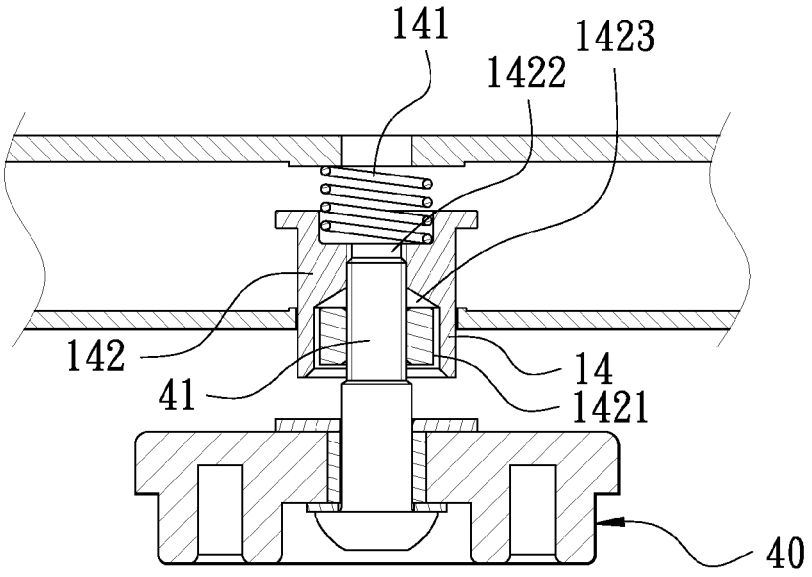
FIG. 8 is a partial sectional view according to the first embodiment of the present invention.
Figure 9:
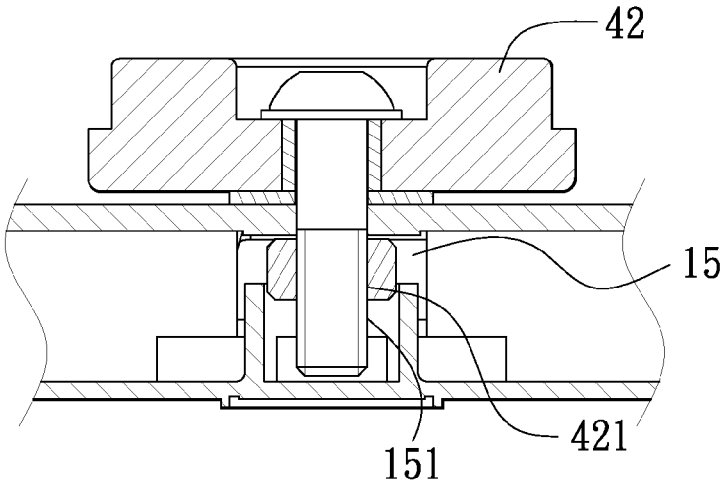
FIG. 9 is another partial sectional view according to the first embodiment of the present invention.

Two ends of the handle 10 extend in the same direction and are provided with a coupling rod 11 and a base 12, respectively. The handle 10 has a grip 131 between the coupling rod 11 and the base 12. Two ends of the grip 131 are provided with two curved pipes 13. The curved pipes 13 are connected with the coupling rod 11 and the base 12, respectively. In this embodiment, the handle 10 can be selectively installed with a grip 131 in a different length. Referring to FIG. 8 and FIG. 9, the coupling rod 11 is provided with a quick-release unit 14. The quick-release unit 14 comprises an elastic member 141 and a retaining member 142. One end of the elastic member 141 is fixed to the coupling rod 11, and another end of the elastic member 141 elastically holds against the retaining member 142. The retaining member 142 has a first retaining portion 1421 and a second retaining portion 1422. The first retaining portion 1421 is a retaining trough which is formed with a bottom surface 1423. The bottom surface 1423 is an oblique surface. The bottom surface 1423 is gradually reduced from the first retaining portion 1421 toward the second retaining portion 1422. The second retaining portion 1422 is a retaining screw hole disposed on the bottom surface 1423. The first retaining portion 1421 has an inner diameter greater than that of the second retaining portion 1422. The base 12 is provided with a limit unit 15. The limit unit 15 comprises a first limit portion 151. The first limit portion 151 is a limit screw hole. In the first embodiment of the present invention, the limit unit 15 comprises a limit screw nut disposed in the base 12. The limit screw nut has the first limit portion 151.

Figure 7:
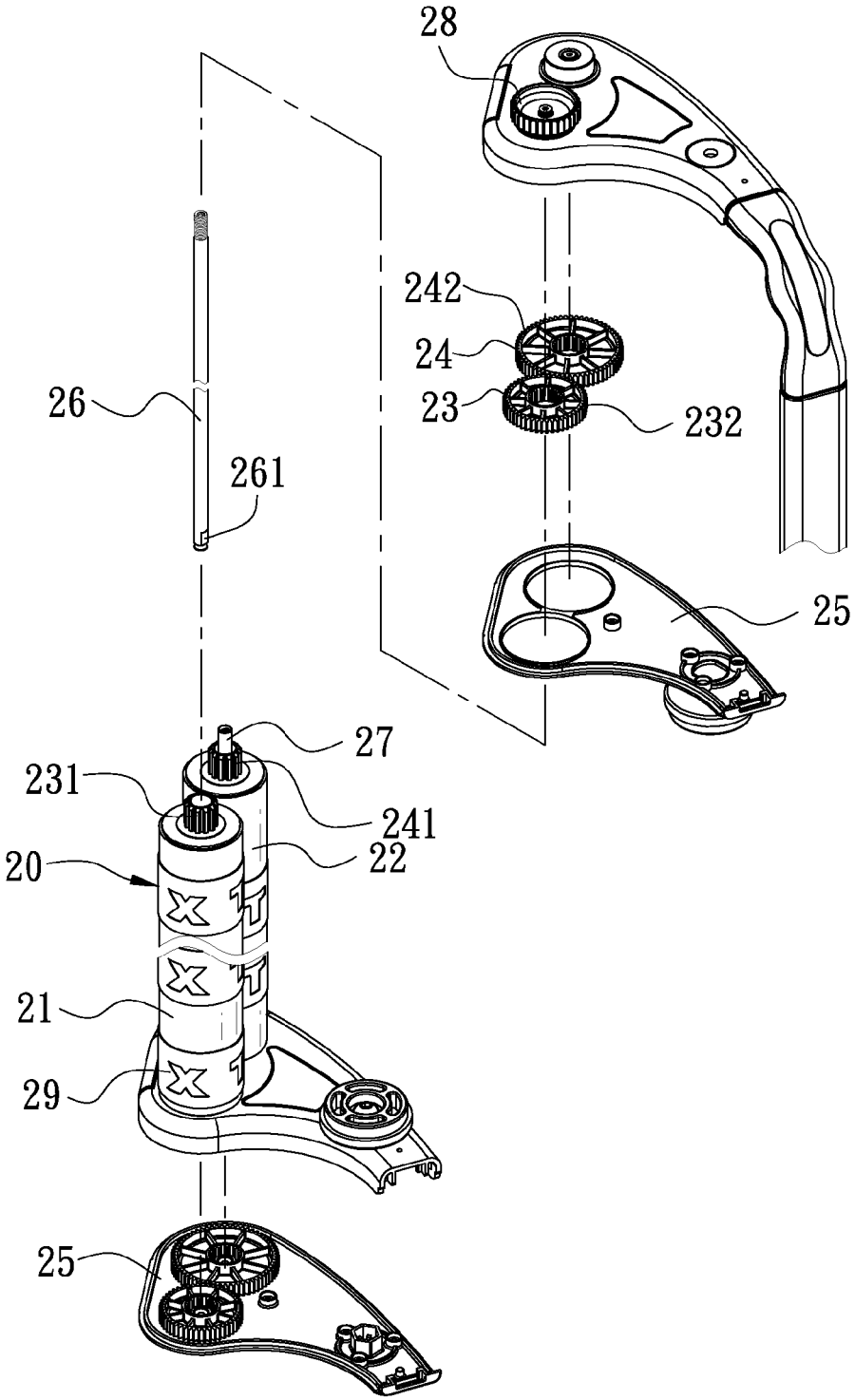
FIG. 7 is an exploded view showing the roller unit according to the first embodiment of the present invention.

The roller unit 20 is pivotally connected between the base 12 and the coupling rod 11. Referring to FIG. 7, the roller unit 20 comprises a first roller 21 and a second roller 22. Two ends of the first roller 21 and the second roller 22 are provided with a first gear assembly 23 and a second gear assembly 24, respectively. The first gear assembly 23 meshes with the second gear assembly 24. The first gear assembly 23 comprises a first axle gear 231. The first axle gear 231 is fixed to one end of the first roller 21. An outer toothed portion of the first axle gear 231 meshes with an inner toothed portion of a drive gear 232. The second gear assembly 24 comprises a second axle gear 241. The second axle gear 241 is fixed to one end of the second roller 22. An outer toothed portion of the second axle gear 241 meshes with an inner toothed portion of a reduction gear 242. An outer toothed portion of the reduction gear 242 meshes with an outer toothed portion of the drive gear 232. The outer toothed portion of the reduction gear 242 has teeth more than those of the outer toothed portion of the drive gear 232. The outer circumference of the first axle gear 231 and the outer circumference of the second axle gear 232 can be selectively fitted with the drive gear 232 and the reduction gear 242 having different numbers of teeth. The gear ratio of the teeth on the reduction gear 242 and the drive gear 232 is in the range of 1.1 to 1.3. In the first embodiment of the present invention, the number of the teeth on the reduction gear 242 is 62. The number of the teeth on the drive gear 232 is 48. This is just an embodiment, and the present invention is not limited to this embodiment. The number of the teeth on the reduction gear 242 and the number of the teeth of the drive gear 232 and their gear ratio can be different. At least one of the outer wall of the first roller 21 and the outer wall of the second roller 22 is provided with a tension judgement member 29. The tension judgement member 29 is a pattern. The pattern is selected from one of a convex pattern and a concave pattern or a combination thereof. The outer sides of the first roller 21 and the second roller 22 are provided with a casing 25, respectively. The roller unit 20 further comprises a first connecting rod 26 and a second connecting rod 27. The first connecting rod 26 and the second connecting rod 27 are disposed in the first roller 21 and the second roller 22, respectively. The first connecting rod 26 and the first roller 21 are coaxial. The second connecting rod 27 and the second roller 22 are coaxial. Two ends of the first connecting rod 26 and the second connecting rod 27 are pivotally connected with the coupling rod 11 and the base 12, respectively. One end of the first connecting rod 26 is provided with an adjustment knob 28 corresponding to the first gear set 23. Another end of the first connecting rod 26 is provided with an engaging surface 261, such that the first connecting rod 26 is fixed to the base 12 through the engaging surface 261. The two ends of the second connecting rod 27 are pivotally connected with the coupling rod 11 and the base 12, respectively.

The film packing device of the first embodiment of the present invention further comprises a first film application unit 40.

The first film application unit 40 comprises a first film seat 41 and a second film seat 42. The first film seat 41 and the second film seat 42 are disposed oppositely. The first film seat 41 comprises a first fixing portion 411 corresponding to the second retaining portion 1422. The second film seat 42 comprises a second fixing portion 421 corresponding to the limit unit 15. Both the first fixing portion 411 and the second fixing portion 421 are screws. The first fixing portion 411 and the second fixing portion 421 are screwed to the second retaining portion 1422 and the limit unit 15, respectively, such that the first film application unit 40 is pivotally connected to the coupling rod 11 and the base 12 through the first fixing portion 411 and the second fixing portion 421. In a second embodiment of the present invention, the first film application unit 40 further comprises a paper reel between the first film seat 41 and the second film seat 42.

Referring to FIG. 6, FIG. 8, and FIG. 9, when in use, a roll of film having the paper reel is first mounted to the first film application unit 40, and then the film is pulled out to pass through the first roller 21 and the second roller 22. After that, the film is attached to an article for packing. Because the roller unit 20 is pivotally connected between the base 12 and the coupling rod 11, the roller unit 20 has larger turning angle and range. In cooperation with the gear ratio of the first gear set 23 and the second gear set 24, the roller unit 20 can generate larger pulling force and binding force when packing the article. Thus, the present invention can adjust the direction, the pulling force and the tightness of packing as desired, so that the user can pack the article quickly and tightly and adjust the strength of film.

The gear ratio can be selected or determined based on existing and new to develop types of high technology packaging films as know as nano tech films. This will result in an optimal reproducible and consistent application of the packaging film what is essential for the use of film to stabilize loads on pallets. This is unique and new.

In addition, through the roller unit 20, the film packing device can generate even and stable pulling force and binding force for packing the article so that the user can pack the article on the pallet securely.

When the user wants to replace the roll of film having the paper reel on the first film application unit 40, the first film seat 41 is pushed to compress the elastic member 141 of the quick-release unit 14, such that the roll of film having the paper reel can disengage from the second film seat 42 with ease for the user to take out the roll of film having the paper reel to get it replaced. Through the quick-release unit 14, the user can replace or take out the roll of film having the paper reel quickly and conveniently.

When the user wants to disassemble or replace the first film application unit 40, the roll of film having the paper reel on the first film application unit 40 is first disassembled, and the then the first fixing portion 411 is unscrewed out of the second retaining portion 1422 and the second fixing portion 421 is unscrewed out of the limit unit 15. In this way, the user can take out the first film application unit 40 to get it replaced.

Figure 11:
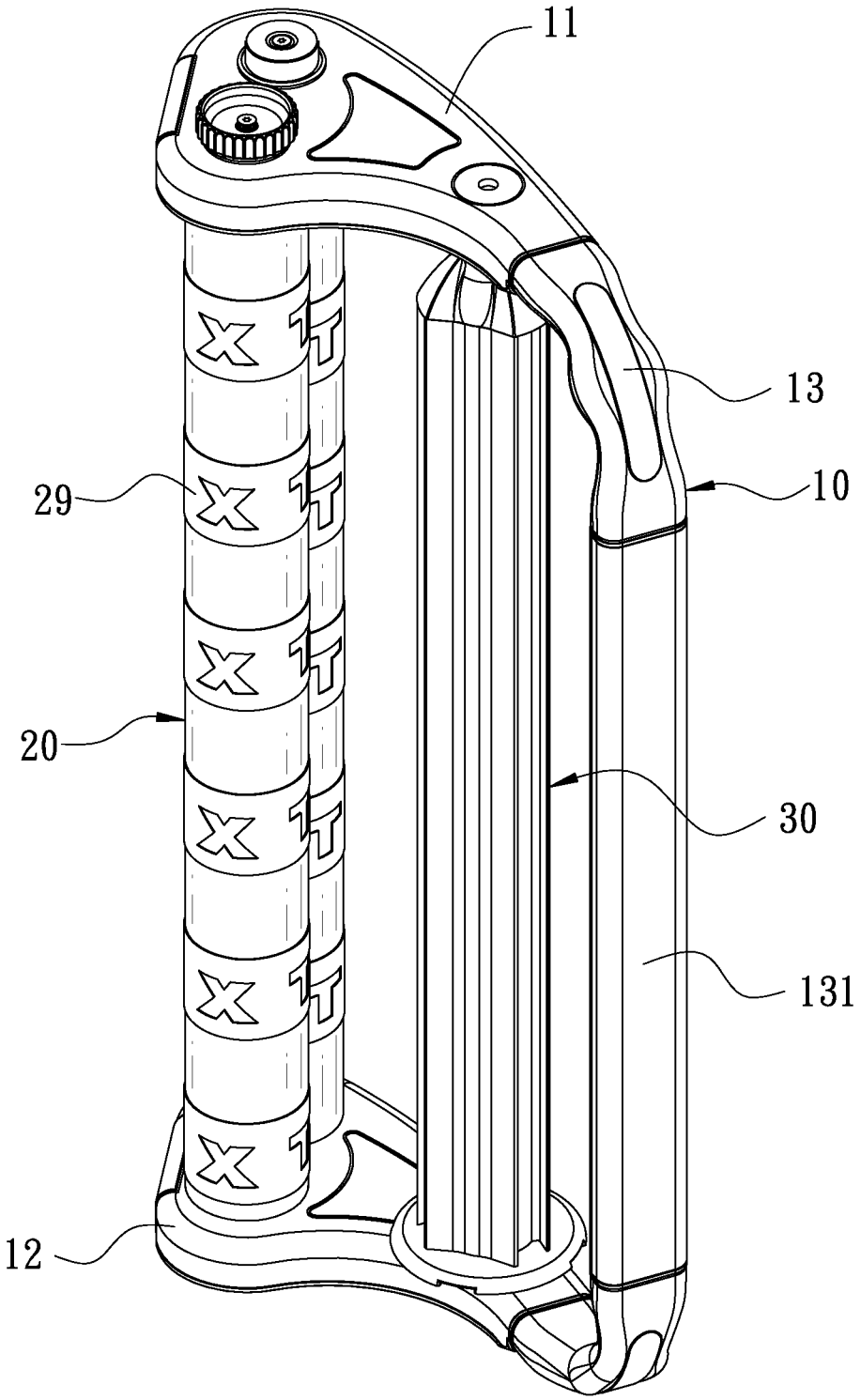
FIG. 11 is a perspective view according to a second embodiment of the present invention.
Figure 12:
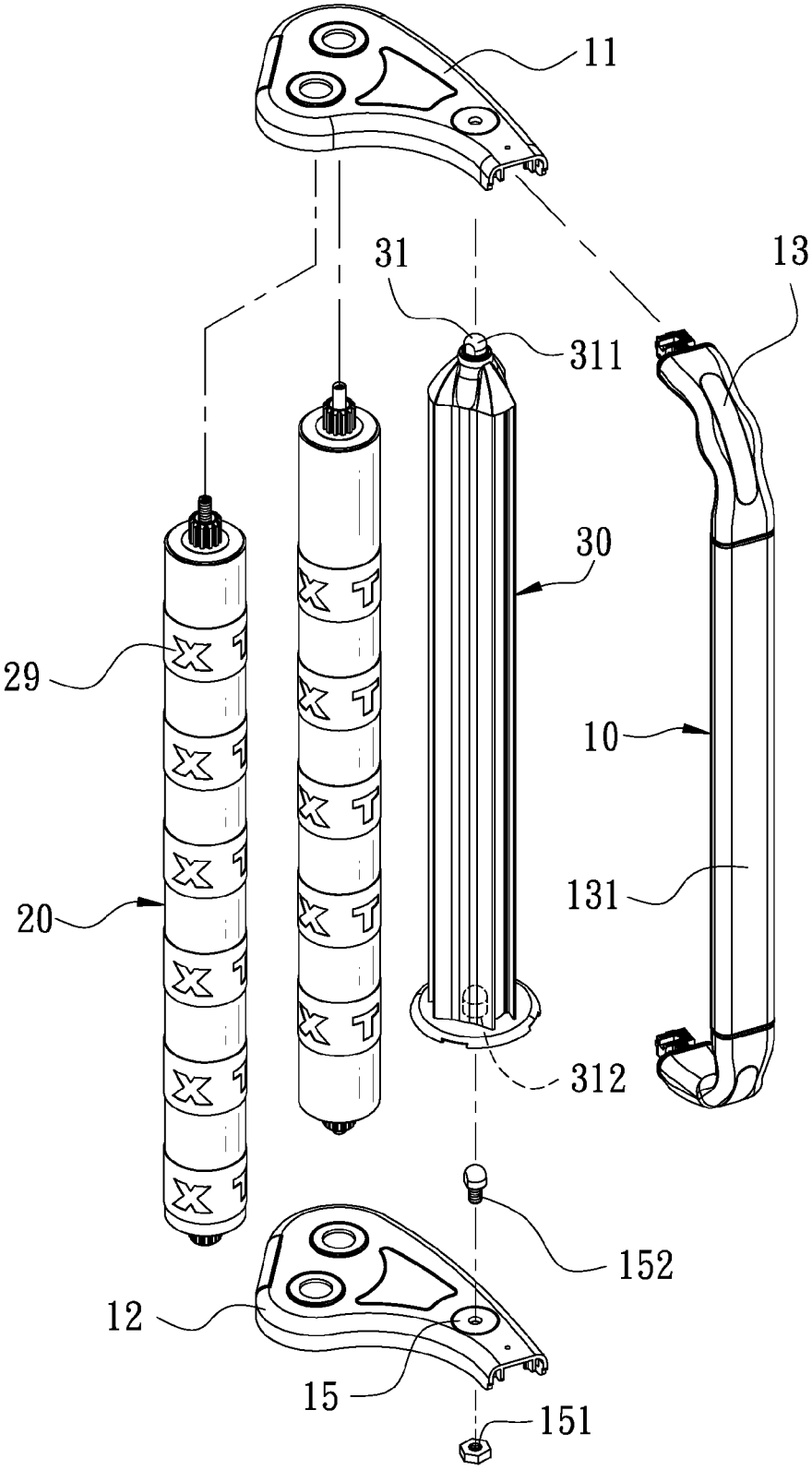
FIG. 12 is an exploded view according to the second embodiment of the present invention.
Figure 14:
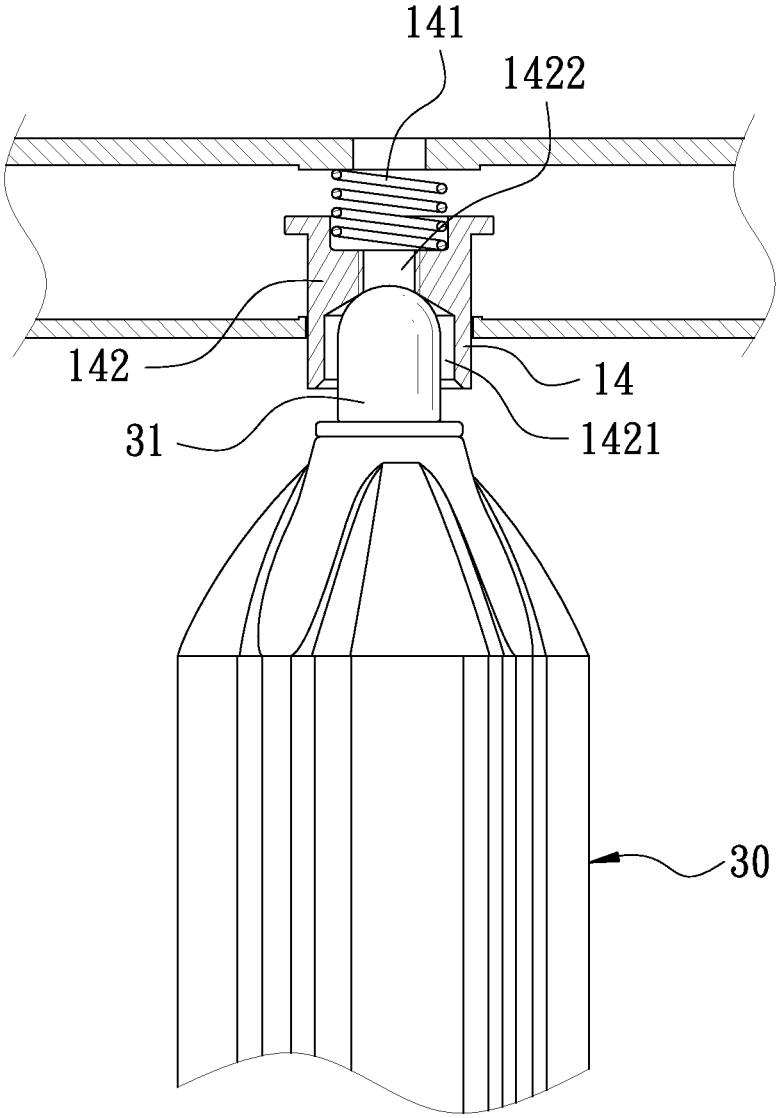
FIG. 14 is a partial sectional view according to the second embodiment of the present invention.
Figure 15:
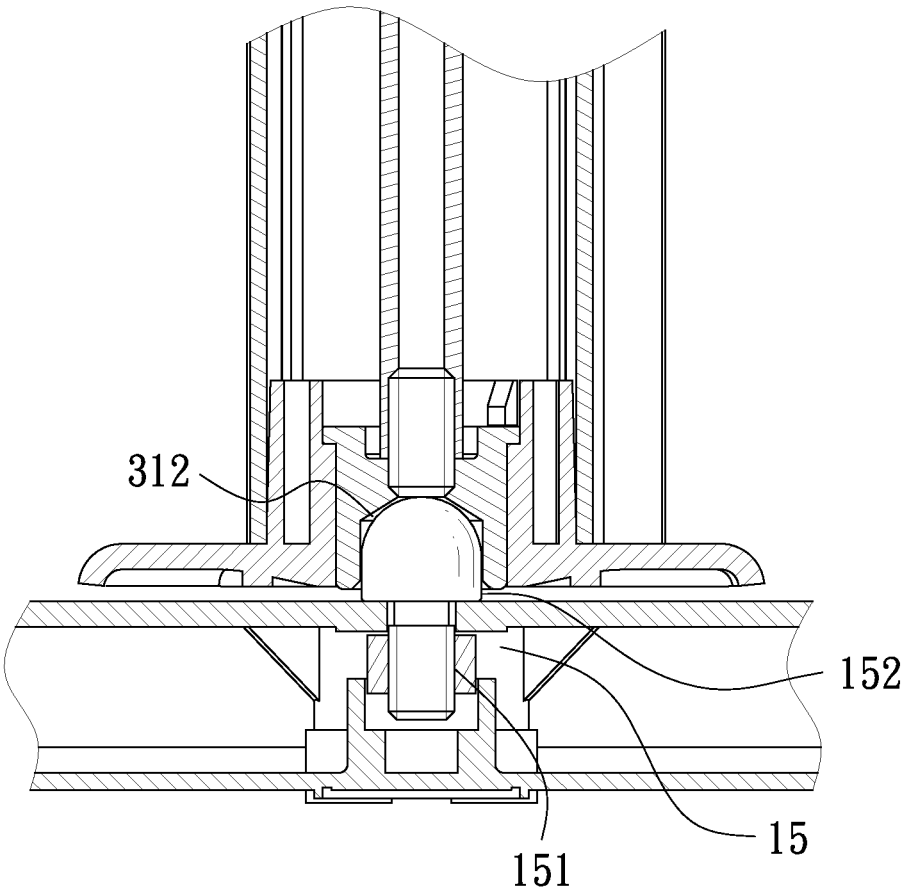
FIG. 15 is another partial sectional view according to the second embodiment of the present invention.

FIG. 11 is a perspective view according to a second embodiment of the present invention. FIG. 12 is an exploded view according to the second embodiment of the present invention. Referring to FIG. 14 and FIG. 15, the second embodiment and the first embodiment are substantially similar with the exceptions described hereinafter. The limit unit 15 comprises a first limit portion 151 and a second limit portion 152. The first limit portion 151 is a limit screw hole. The second limit portion 152 is a limit block. One end of the limit block is screwed to the limit screw hole. Another end of the limit block extends out of the base 12. A second film application unit 30 is pivotally connected between the base 12 and the coupling rod 11. The second film application unit 30 comprises an axial rod 31. The axial rod 31 comprises a first positioning portion 311 and a second positioning portion 312 corresponding to the first retaining portion 1421 and the second limit portion 152 respectively. The first positioning portion 311 is a positioning protrusion. The second positioning portion 312 is a positioning recess. The second film application unit 30 is pivotally connected to the coupling rod 11 and the base 12 through the first positioning portion 311 and the second positioning portion 312. The first retaining portion 1421 of the quick-release unit 14 is biased by the elastic member 14 to fit on the first positioning portion 311. In the second embodiment of the present invention, the axial rod 31 can be provided with a roll of film not having a paper reel.

Figure 13:
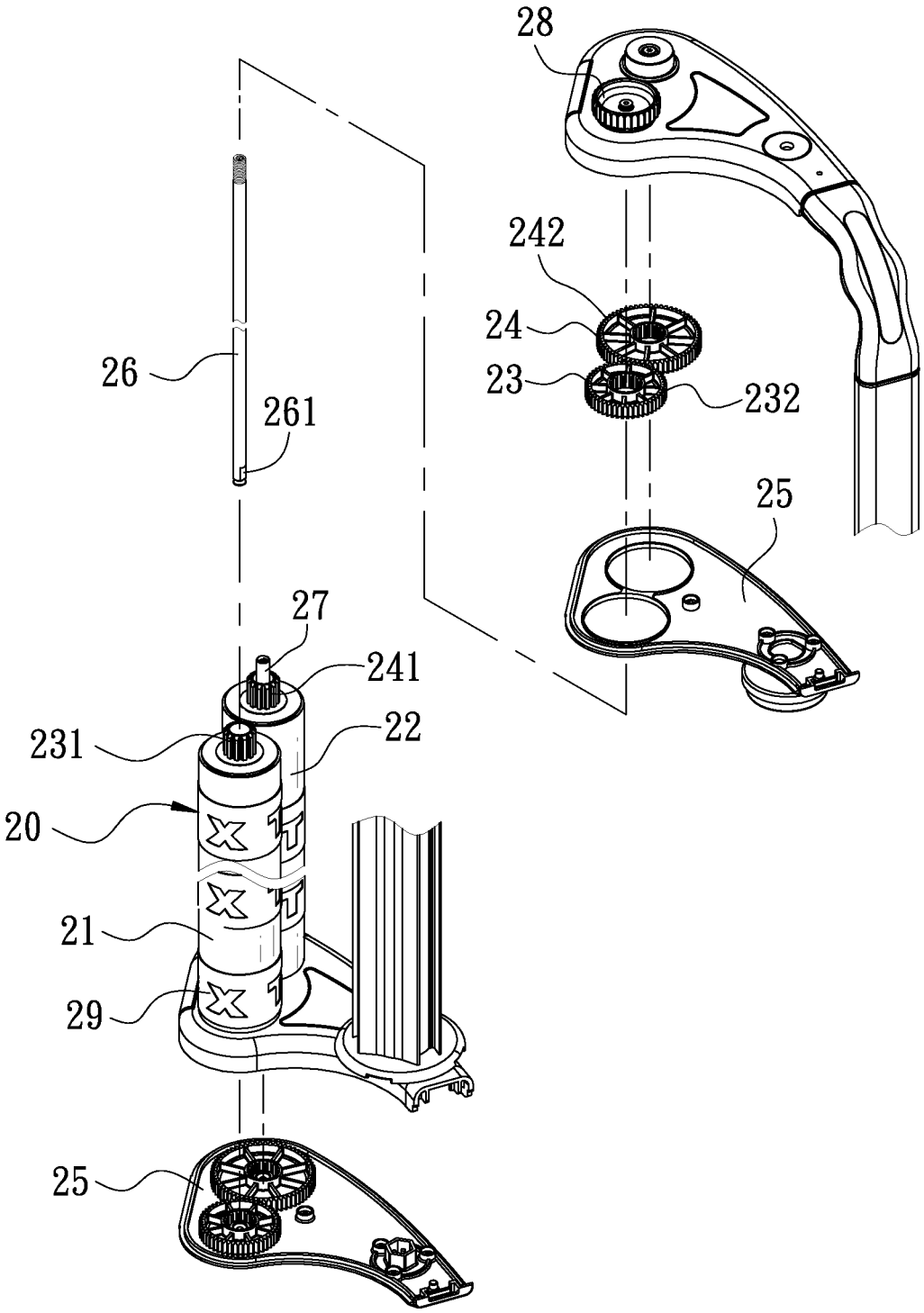
FIG. 13 is an exploded view showing the roller unit according to the second embodiment of the present invention.

Referring to FIG. 13, FIG. 14, and FIG. 15, when the user wants to install the second film application unit 30 or replace the roll of film not having the paper reel, the first positioning portion 311 at one end of the axial rod 31 is pushed against the first retaining portion 1421 of the quick-release unit 14 for the retaining portion 1421 to compress the elastic member 141, and the second positioning portion 312 at the other end of the axial rod 31 disengages from a protruding portion 1521 of the limit unit 15, such that the second film application unit 30 can be taken out for the user to take out the roll of film not having the paper reel to get it replaced. Through the quick-release unit 14, the user can take out the second film application unit 30 quickly to replace or take out the roll of film not having the paper reel conveniently.

Referring to FIG. 8, FIG. 9 as well as FIG. 14, FIG. 15, through the first film application unit 40, the film packing device can be mounted with a roll of film having a paper reel, and through the second film application unit 30, the film packing device can be mounted with a roll of film not having a paper reel. By a replacement of few parts, the film packing device can be applied to different types of rolls of film having or not having a paper reel and provide a stable packing effect.

The present invention is made to solve a problem of the way the packing film is applied manually. The purpose of the packing film is:

1 stabilize the load on pallets 2 protect products against UV light 3 avoid tamper by hiding the products in opaque film 4 bundle multiple parcels to 1 package to save on transport costs The present invention will allow the user to stabilize a pallet load fast, without bending, safely walking forward with a consistent and reproducible force to the load. With the invention the roll of film can be used till the very end.

Referring to FIG. 6 and FIG. 12, it is noted that the handle can be selectively mounted with the handle 131 in a different length to form a different interval between the coupling rod 11 and the base 12 for installation of different lengths of film application units so as to adjust different types of film.

Referring to FIG. 7 and FIG. 13, the drive gear 232 and the reduction gear 242 can be connected and positioned quickly through the first axle gear 231 and the second axle gear 241 to form the first gear set 23 and the second gear set 24. The gear ratio of the drive gear 232 and the reduction gear 242 can be adjusted according to different films to provide the best application effect.

Accordingly, the film packing device can be applied for various occasions and cooperate with an oncoming film effectively to achieve the best effect.

Figure 16:
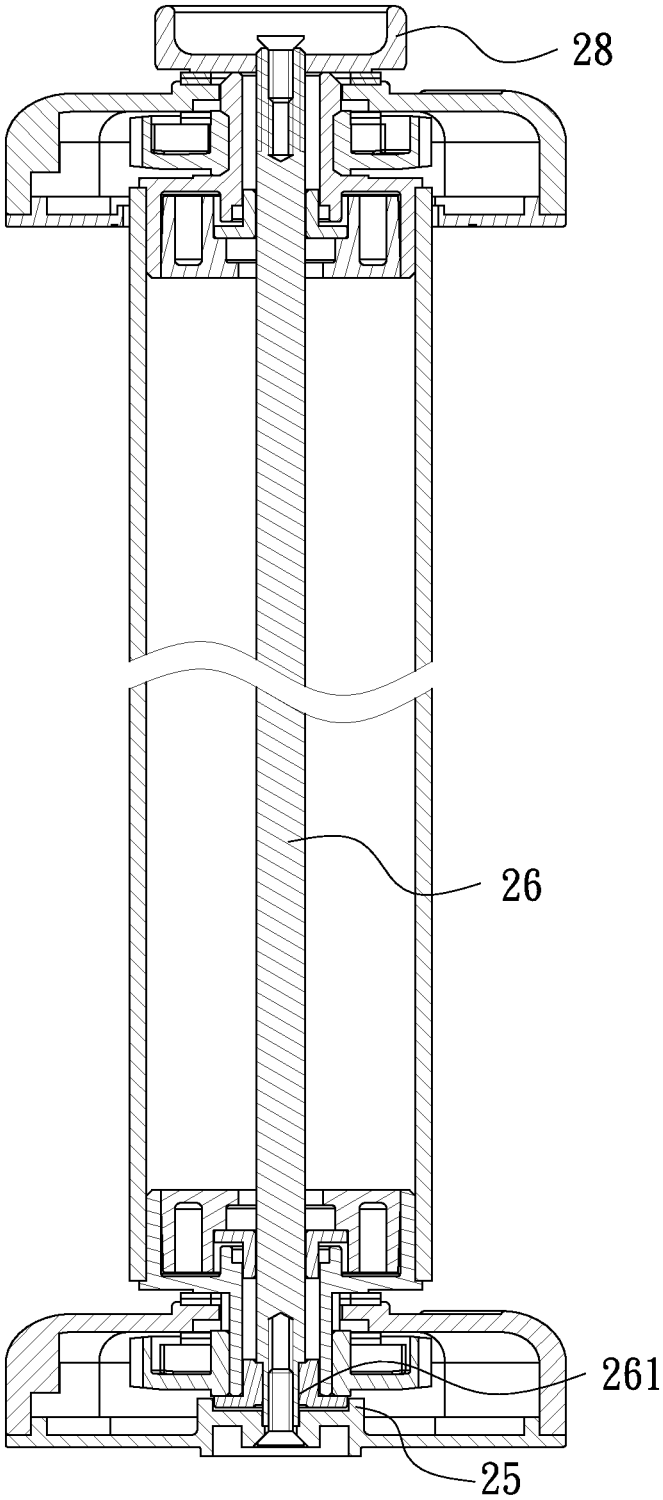
FIG. 16 is a schematic view showing the first connecting rod of the present invention when in use.

Referring to FIG. 16, another end of the first connecting rod 26 is provided with the engaging surface 261 for the end of the first connecting rod 26 to be secured to the base 12. The user can turn the adjustment knob 28 at one end of the first connecting rod 26 to tighten the first connecting rod 26 so as to slightly adjust the tension of the film.

It is noted that the film packing device of the present invention can be used stably without bending down when in use and it can be operated with a single hand. Of a roll gets damaged by dropping on the floor the roll is on most cases useless. With the invention the operator will be able to use the roll of packaging film till the very end.

Figure 10:
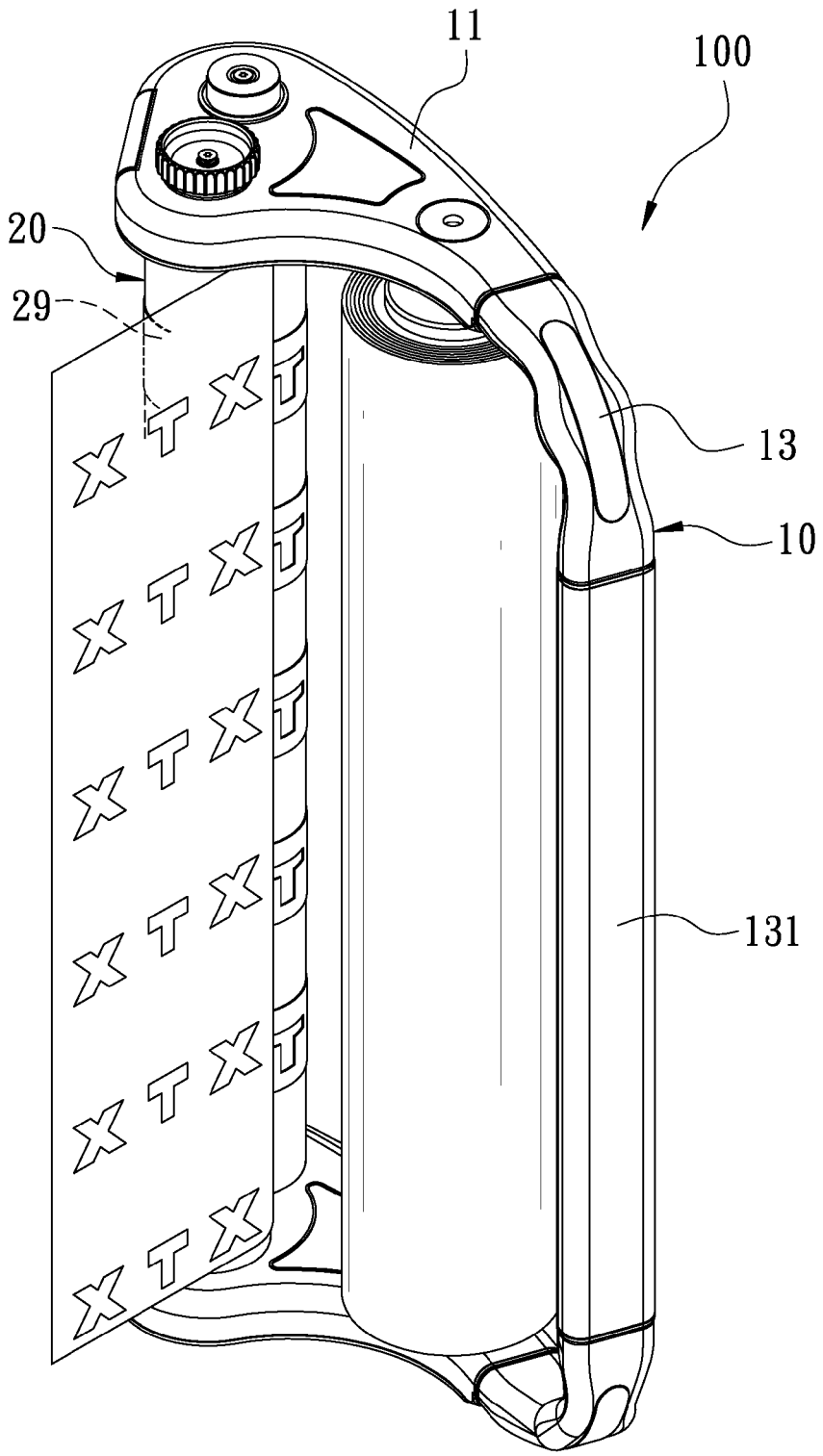
FIG. 10 is a schematic view according to the first embodiment of the present invention when in use.

Referring to FIG. 16 and FIG. 10, the present invention is provided with the tension judgement member 29. The tension judgement member 29 is a pattern. The pattern is selected from one of a convex pattern and a concave pattern or a combination thereof. Also the tension judgement member 29 comprise a unique series number When the film passes through the tension judgement member 29, the pattern is transferred to the film. Thus, the user can judge the tension of the film through the size of the deformed pattern after the film is pulled to extend.

The tension judgement member 29 or any other embossing will allow the user to check the result and therefore the quality of the way the film is applied. This is new and unique. In general, the tension judgement member 29 will reduce waste of packaging film due to the optimal application. Producers of film can offer optimal use of their products. The present invention will activate the thermoplastic film to make it elastic. After application the film wants to return to its original "position". This will add extra force to load after a period of time.

Figure 17:
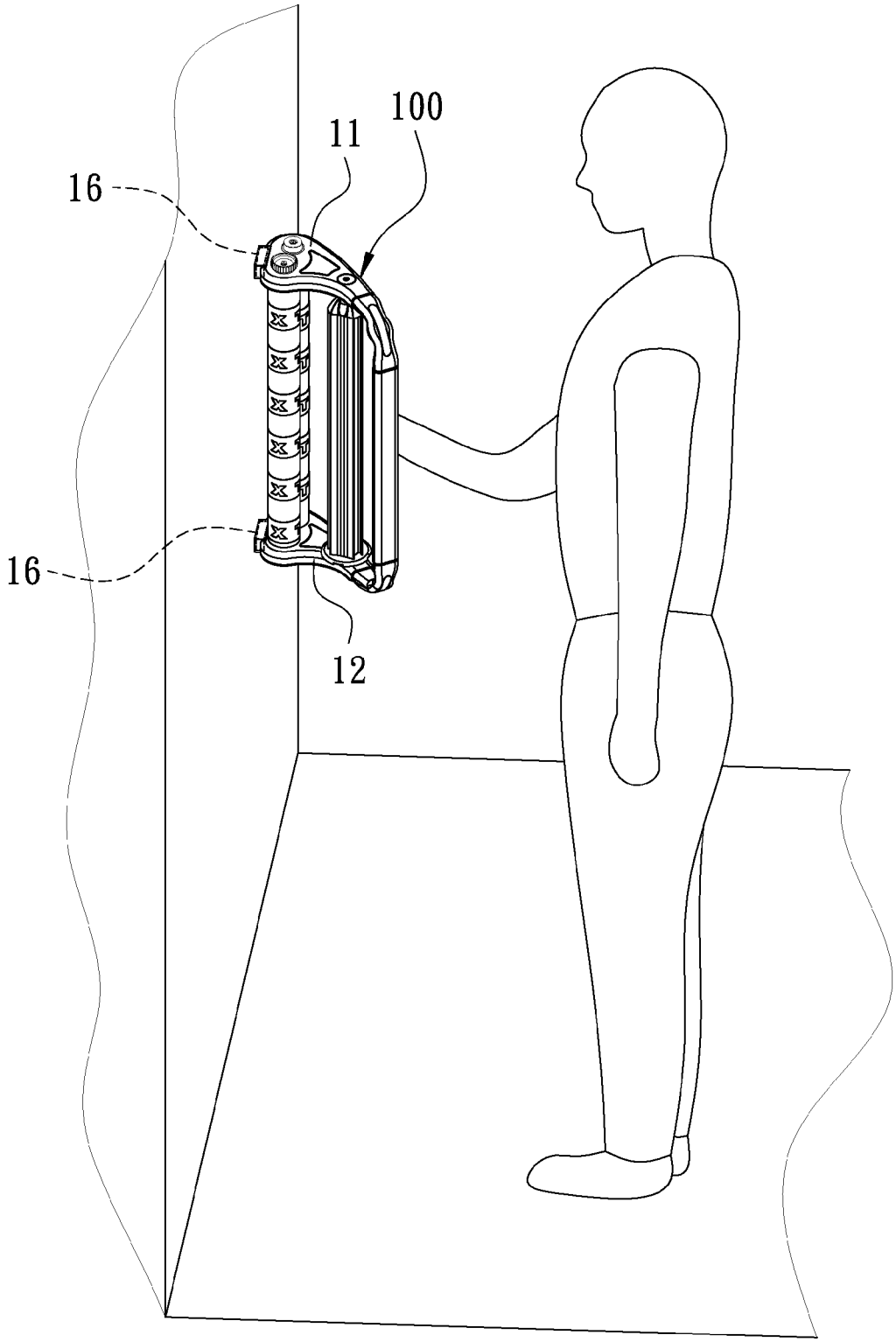
FIG. 17 is a perspective view according to a third embodiment of the present invention.

Referring to FIG. 17, the coupling rod 11 and the base 12 are provided with a magnets member 16, the user can hang the film packing device 100 on a metal surface. This will make it easier to grab the film packing device 100 on a convenient ergonomic height, also extend life time of the film packing device 100, avoid damage.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A film packing device comprising:

a handle;

the handle comprising two ends, a coupling rod and a base;

the coupling rod and the base being provided on the two ends respectively, the coupling rod comprising a retaining member; the retaining member comprising a first retaining portion and a second retaining portion the base comprising a limit unit, the limit unit comprising a first limit portion and a second limit portion;

wherein a first film application unit and a second film application unit being interchangeably mounted and engaged with the handle;

the first film application unit comprising a first film seat and a second film seat, the first film seat and the second film seat being disposed oppositely; the first film seat comprising a first fixing portion; the first fixing portion corresponding to the second retaining portion;

the second film seat comprising a second fixing portion; the second fixing portion corresponding to the first limit portion; the second film application unit comprising an axial rod; the axial rod comprising a first positioning portion and a second positioning portion; the first positioning portion and the second positioning portion being disposed oppositely; the first positioning portion corresponding to the first retaining portion; the second positioning portion corresponding to the second limit portion;

in response to the handle being engaged with the first film application unit, the second retaining portion of the retaining member being engaged with the first fixing portion of the first film application unit and the first limit portion of the limit unit being engaged with the second fixing portion of the first film application unit;

in response to the handle being engaged with the second film application unit, the first retaining portion of the retaining member being engaged with the first positioning portion of the second film application unit and the second limit portion of the limit unit being engaged with the second positioning portion of the second film application unit;

in response to the handle being engaged with the first film application unit, the first film application unit being configured to be mounted with a roll of film with a paper reel; and in response to the handle being engaged with the second film application unit, the second film application unit being configured to be mounted with a roll of film without a paper reel.

2. The film packing device as claimed in claim 1, wherein the coupling rod being provided with a quick-release unit, the quick-release unit comprises an elastic member and the retaining member, the elastic member elastically holds against the retaining member.

3. The film packing device as claimed in claim 1, wherein the first retaining portion is a retaining trough, the retaining member is formed with a bottom surface, the second retaining portion is a retaining screw hole disposed on the bottom surface, the first retaining portion has an inner diameter greater than that of the second retaining portion.

4. The film packing device as claimed in claim 3, wherein the first limit portion is a limit screw hole and the second limit portion is a limit block, one end of the limit block is screwed to the limit screw hole, another end of the limit block extends out of the base, wherein the first positioning portion is a positioning protrusion, and the second positioning portion is a positioning recess, wherein the first fixing portion and the second fixing portion are screws.

5. The film packing device as claimed in claim 1, further comprises a roller unit, the roller unit is pivotally connected between the base and the coupling rod, the roller unit comprises a first roller and a second roller, two ends of the first roller and the second roller are provided with a first gear assembly and a second gear assembly respectively, the first gear assembly meshes with the second gear assembly, the first gear assembly comprises a first axle gear, the first axle gear is fixed to one end of the first roller, an outer toothed portion of the first axle gear meshes with an inner toothed portion of a drive gear, the second gear assembly comprises a second axle gear, the second axle gear is fixed to one end of the second roller, an outer toothed portion of the second axle gear meshes with an inner toothed portion of a reduction gear, an outer toothed portion of the reduction gear meshes with an outer toothed portion of the drive gear.

6. The film packing device as claimed in claim 5, wherein at least one of an outer wall of the first roller and an outer wall of the second roller is provided with a tension judgement member, the tension judgement member is a pattern, the pattern is a convex pattern or a concave pattern.

7. The film packing device as claimed in claim 5, wherein outer sides of the first roller and the second roller are provided with a casing respectively, the roller unit further comprises a first connecting rod and a second connecting rod, the first connecting rod and the second connecting rod are disposed in the first roller and the second roller respectively, the first connecting rod and the first roller are coaxial, the second connecting rod and the second roller are coaxial, one of the two ends of the first connecting rod is provided with an adjustment knob, the other of the two ends of the first connecting rod is fixed to the base, the two ends of the second connecting rod are pivotally connected with the coupling rod and the base respectively.

8. The film packing device as claimed in claim 5, wherein the number of teeth on the reduction gear is greater than that of teeth on the drive gear.

9. The film packing device as claimed in claim 1, wherein the handle has a grip, two ends of the grip are provided with two curved pipes, the curved pipes are connected with the coupling rod and the base, respectively.

* * * * *